US010787773B2

(12) United States Patent
Thiesse et al.

(10) Patent No.: US 10,787,773 B2
(45) Date of Patent: Sep. 29, 2020

(54) CALIBRATION SYSTEM AND METHOD FOR A SPRAYING MACHINE

(71) Applicant: Caterpillar SARL, Geneva (CH)

(72) Inventors: Chad M. Thiesse, Brooklyn Park, MN (US); Andrea Fontana, Porto Tolle-Rovido (IT)

(73) Assignee: Caterpillar SARL, Geneva (CH)

( * ) Notice: Subject to any disclaimer, the term of this patent is extended or adjusted under 35 U.S.C. 154(b) by 0 days.

(21) Appl. No.: 16/425,361

(22) Filed: May 29, 2019

(65) Prior Publication Data

US 2020/0048844 A1 Feb. 13, 2020

Related U.S. Application Data

(60) Provisional application No. 62/716,112, filed on Aug. 8, 2018.

(51) Int. Cl.
*E01C 19/00* (2006.01)
*E01C 19/17* (2006.01)
*E01C 19/48* (2006.01)

(52) U.S. Cl.
CPC ..... *E01C 19/17* (2013.01); *E01C 19/4873* (2013.01)

(58) Field of Classification Search
CPC ..... E01C 19/17; E01C 19/4873
USPC ..... 404/72, 75, 101, 108, 111
See application file for complete search history.

(56) References Cited

U.S. PATENT DOCUMENTS 4,347,742 A * 9/1982 Lohr, Jr. ..... G01N 15/00 73/866.4
4,540,041 A * 9/1985 Backlund ..... F24V 50/00 165/45
7,654,772 B1 * 2/2010 Zimmerman ..... E01C 19/1054 404/101
7,802,737 B2 9/2010 Rayner
9,845,579 B2 12/2017 Pembleton et al.
2009/0257824 A1 * 10/2009 Musil ..... E01C 19/174 404/79
2012/0043401 A1 2/2012 Heusinger et al.

FOREIGN PATENT DOCUMENTS

CN 103362052 A 10/2013

* cited by examiner

*Primary Examiner* — Raymond W Addie
(74) *Attorney, Agent, or Firm* — Bookoff McAndrews

(57) ABSTRACT

A paving system may include a paving machine, including a paving material delivery assembly, including a hopper, a conveyor assembly, an auger, and a screed. The paving machine may also include an emulsion fluid delivery assembly including a plurality of spray bars, wherein each spray bar includes one or more nozzles. The paving system may also include a controller and a display interface. The controller may be configured to receive inputs from the display interface indicative of a mass and an area of emulsion fluid delivered from one active nozzle in order to calibrate the emulsion fluid delivery assembly.

20 Claims, 4 Drawing Sheets

CALIBRATION SYSTEM AND METHOD FOR A SPRAYING MACHINE

CROSS-REFERENCE TO RELATED APPLICATIONS

This application claims the benefit of priority from the U.S. Provisional Application No. 62/716,112, filed on Aug. 8, 2018, which is incorporated by reference herein in its entirety

TECHNICAL FIELD

The present disclosure relates generally to a road construction machine, and more particularly, to a system and method for calibrating emulsion fluid delivery in a spraying machine.

BACKGROUND

The present disclosure relates to paving machines that are used in road surface construction and repairs. Paving machines are typically utilized to lay asphalt or other paving material. Paving often includes delivering (e.g., spraying) a pre-coating tack, emulsion fluid, or other treatment fluid on the ground or road surface to aid in the bonding of the new pavement. Paving machines aim to spray a constant amount of treatment fluid to the ground surface. Different paving operations may involve different treatment fluids, and different treatment fluids may have different properties, including density, viscosity, etc. The different properties of the treatment fluid may affect the delivery rate and/or the spray area of the treatment fluid.

U.S. Pat. No. 9,845,579, issued to Pembleton et al. on Dec. 19, 2017 ("the '579 patent"), describes a pavement coating system having a shiftable spray bar. The '579 patent discloses a pavement coating system that uses a pump to deliver one or more pump counts of coating material into a container. The container may then be weighed or otherwise measured to produce a calibration scale factor, which may then be input into the control system in order to correlate a pump count with the output mass or volume of the coating material. The control system of the '579 patent also is coupled to one or more speed sensors, and adjusts a pump rate in light of the sensed ground speed to maintain a predetermined application rate. The '579 patent discloses calibrating the mass or volume of coating material delivered, but the control system does not take into account, among other things, a spray area of one or more nozzles. Accordingly, the control system does not adjust a spray rate to maintain a desired amount of coating material over an area of the ground surface. The paving machine of the present disclosure may solve one or more of the problems set forth above and/or other problems in the art. The scope of the current disclosure, however, is defined by the attached claims, and not by the ability to solve any specific problem.

SUMMARY

In one aspect, a paving system may include a paving machine, including a paving material delivery assembly, including a hopper, a conveyor assembly, an auger, and a screed. The paving machine may also include an emulsion fluid delivery assembly including a plurality of spray bars, wherein each spray bar includes one or more nozzles. The paving system may also include a controller and a display interface. The controller may be configured to receive inputs from the display interface indicative of a mass and an area of emulsion fluid delivered from one active nozzle in order to calibrate the emulsion fluid delivery assembly.

In another aspect, a control system for a paving machine may include a plurality of spray bars coupled to the paving machine to deliver an emulsion fluid to a ground surface, wherein each of the spray bars includes one or more nozzles. The control system may also include a controller and a display interface. The controller may be operatively coupled to the display interface and to each spray nozzle on the plurality of spray bars to calibrate a delivery of emulsion fluid through the nozzles based on an inputted mass of the emulsion fluid and an inputted area of a spray pattern through one active nozzle.

In a further aspect, a method of calibrating an emulsion fluid delivery system for a paving machine may include selecting an active nozzle, with the active nozzle being one of a plurality of nozzles on one or more spray bars mounted on the paving machine, delivering an emulsion fluid through the active nozzle for a spray duration, measuring a mass of the emulsion fluid delivered through the active nozzle over the spray duration, and inputting the measured mass of the emulsion fluid delivered through the active nozzle over the spray duration into a user interface. The method may also include delivering a spray pulse of the emulsion fluid through the active nozzle, measuring a length and a width of a spray pattern of the emulsion fluid delivered during the spray pulse, and inputting the measured length and width of the spray pattern of the emulsion fluid delivered during the spray pulse into the user interface.

DETAILED DESCRIPTION

Both the foregoing general description and the following detailed description are exemplary and explanatory only and are not restrictive of the features, as claimed. As used herein, the terms "comprises," "comprising," "having," "including," or other variations thereof, are intended to cover a non-exclusive inclusion such that a process, method, article, or apparatus that comprises a list of elements does not include only those elements, but may include other elements not expressly listed or inherent to such a process, method, article, or apparatus.

For the purpose of this disclosure, the term "ground surface" is broadly used to refer to all types of surfaces that form typical roadways (e.g., asphalt, cement, clay, sand, dirt, etc.) or upon which paving material may be deposited in the formation of roadways. In this disclosure, relative terms, such as, for example, "about," "substantially," and "approximately" are used to indicate a possible variation of ±10% in a stated value. Although the current disclosure is described with reference to a paving machine, this is only exemplary. While the present disclosure will be discussed in connection with a paving machine, it is understood that the current disclosure can be applied as to any machine, such as, for example, a paver finisher, a tanker truck, an asphalt finisher, any other machine used in the paving process, or any other machine that includes a spraying system where calibration would be beneficial.

Figure 1:
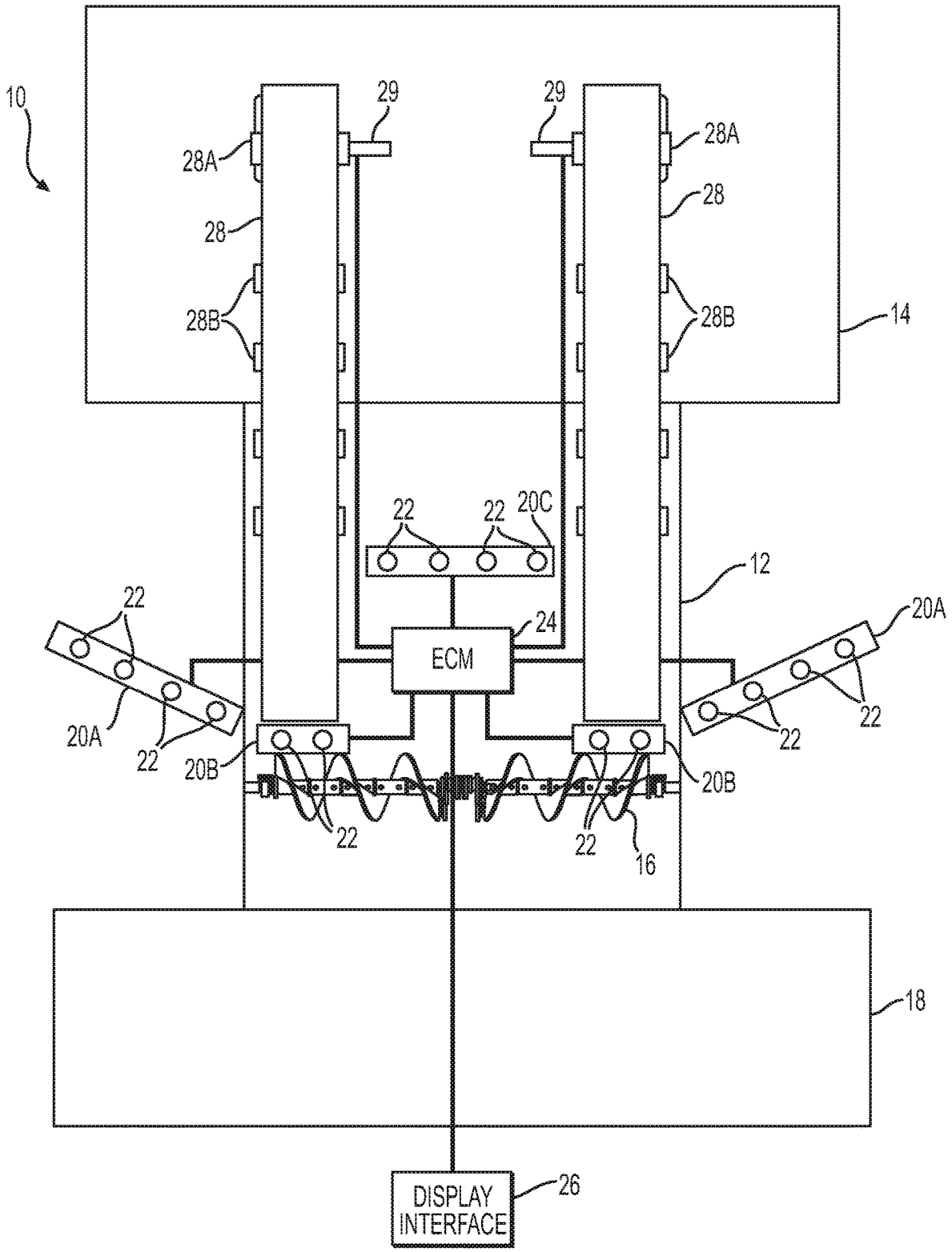
FIG. 1 is an illustration of portions of an exemplary machine, according to aspects of this disclosure.

FIG. 1 illustrates a bottom view of portions of an exemplary paving machine 10, according to the present disclosure. Machine 10 may be any size paver with any paving width. In one aspect, machine 10 may be a small paver, for example, with a maximum paving width of approximately 5.5 meters. Machine 10 includes a frame 12, a hopper 14, and an auger 16. Machine 10 also includes a screed 18, which may be extendible to vary the paving width. Machine 10 may also include a conveyor assembly (not shown) to deliver paving material from hopper 14 to the ground surface below auger 16. The paving material may be spread, smoothed, tamped, etc. by auger 16 and screed 18. Although not shown, machine 10 is coupled to a supply of emulsion fluid, either mounted on machine 10 (e.g., via a tank located to the rear of hopper 14), or connected to machine 10 (e.g., carried by a supply tanker ahead of machine 10). Additionally, one or more spray bars 20 with nozzles 22 are coupled to machine 10 to deliver the emulsion fluid to the ground surface. Spray bars 20 may be fixed on machine 10, or may be movable (e.g., raised or lowered, pivotable, extendable, telescoping, etc.). Individual spray bars 20 or individual nozzles 22 may be activated via a controller, for example, an emulsion control module (or "ECM") 24, and ECM 24 may be in communication with one or more control panels, for example, an operator display interface 26. Display interface 26 may be used to control or monitor one or more aspects of machine 10 via ECM 24.

Although not shown, machine 10 may also include an operator station or cab, from which an operator may maneuver and control machine 10. Machine 10 may also include one or more operator positions, for example, positioned on screed 18 from which an operator may monitor or control aspects of machine 10. One or more display interfaces 26 may be positioned in the operator station or in one or more operator positions on screed 18. Alternatively or additionally, one or more display interfaces 26 may be remote from machine 10.

In one aspect, the one or more spray bars 20 include a plurality of spray bars 20, each including a plurality of nozzles 22. Each of the nozzles 22 on each spray bar 20 may be selectively opened to deliver emulsion fluid to a ground surface, ahead of delivery of the paving material to the ground surface. For example, machine 10 may include two side spray bars 20A, two rear spray bars 20B, and a central spray bar 20C. The two side spray bars 20A may each include four nozzles 22 and may be pivotable relative to machine 10. The two rear spray bars 20B may each include two nozzles 22 and may be positioned to the rear of frame 12, for example, to the rear of ground-engaging elements or tracks 28 and forward of auger 16. Central spray bar 20C may include four nozzles 22 and may be a forward-most spray bar. For example, central spray bar 20C may be positioned between ground-engaging elements or tracks 28 and rearwardly of hopper 14. Each spray bar 20 and individual nozzles 22 may be electronically coupled to ECM 24. Moreover, display interface 26 may be coupled to ECM 24 to control and monitor the status of spray bars 20 and nozzles 22.

ECM 24 may include a computer or computer readable memory storing computer executable instructions to control delivery of emulsion fluid through spray bars 20 and nozzles 22. ECM 24 may be configured to selectively control the delivery of emulsion fluid from the supply by controlling a pump coupled to the supply and spray bars 20 via one or more hoses. ECM 24 may also be operatively coupled to nozzles 22 to open or close individual nozzles 22, for example, by controlling the opening and closing of one or more pneumatic valves associated with each nozzle 22. Additionally, ECM 24 may be configured to receive data from one or more sensors, for example, one or more sensors measuring the speed or direction of machine 10. In one aspect, one or more sensors 29 may be in communication with elements driving each track 28 to measure a speed or direction of each track 28. For example, one sensor 29 may be coupled to a drive wheel 28A or idler 28B of each track 28 to measure the speed of each track 28. Sensors 29 may be wired or wirelessly coupled to ECM 24, and ECM 24 may calculate a speed and direction for machine 10 based on the information received from sensors 29. Accordingly ECM 24 may also be configured to determine a distance traveled by machine 10. ECM 24 may further be configured to receive user commands or information from a user input device, for example, from display interface 26. ECM 24 may be wired or wirelessly connected (e.g., via Bluetooth®, WiFi, or other connection protocol) to nozzles 22, display interface 26, sensors, and other components of machine 10.

Figure 4:
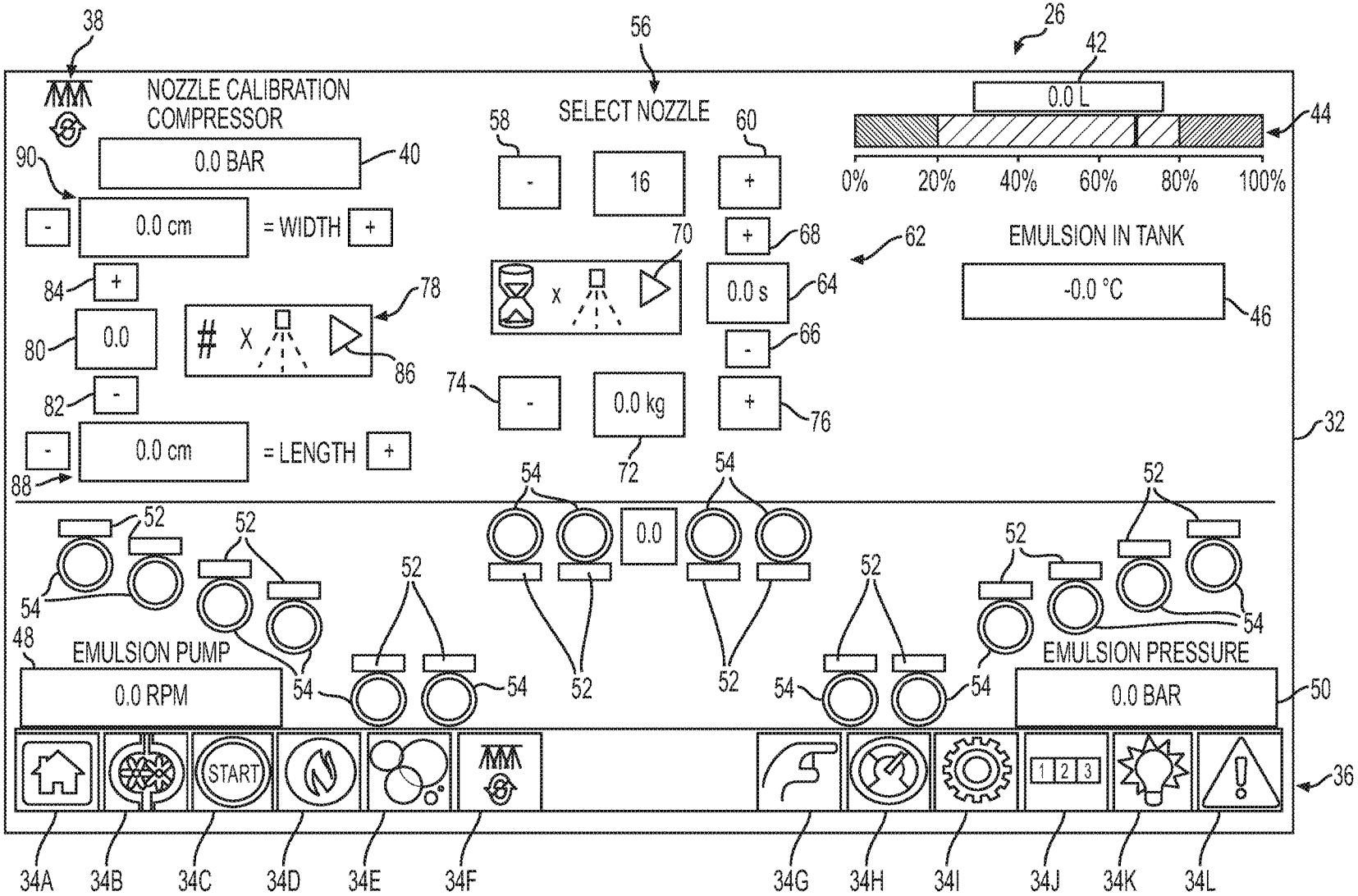
FIG. 4 is an illustration of an exemplary display interface of the exemplary machine of FIG. 1.

As discussed in greater detail with respect to FIG. 4, display interface 26 includes a display with a series of display and input options. Display interface 26 may be operable to control the delivery of emulsion fluid by opening or closing one or more internal valves and/or by controlling the operation of emulsion pumps, for example, via ECM 24. Furthermore, the functions and capabilities of display interface 26 may be combined into a touch screen user interface. As noted above, one or more display interfaces 26 may be positioned on machine 10 or may be remote from machine 10, for example, on a smartphone, tablet, or laptop. In either aspect, one or more display interfaces 26 may be wired or wirelessly connected to ECM 24.

Figure 2:
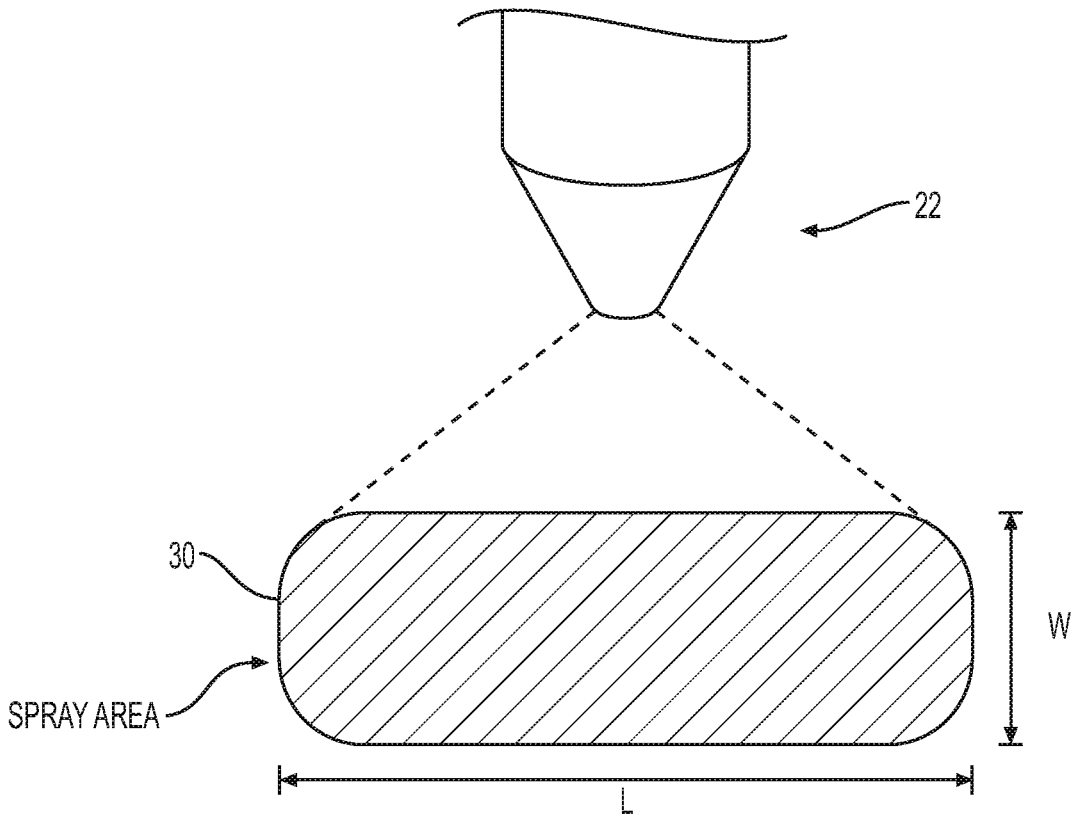
FIG. 2 is an illustration of an exemplary spray nozzle and a corresponding spray pattern of the exemplary machine of FIG. 1.

FIG. 2 illustrates an exemplary spray pattern 30 from one nozzle 22. In one aspect, all of nozzles 22 on spray bars 20 are identical, and thus deliver a common spray pattern 30. Nozzle 22 delivers the emulsion fluid to the ground surface to form spray pattern 30 on an area of the ground surface. Spray pattern 30 has a length L and a width W. Spray pattern 30 is shown as being substantially rectangular, but this disclosure is not so limited, as spray pattern 30 may take other shapes depending on the particular type of nozzle. Because nozzles 22 on spray bars 20 are the same type of nozzle, testing one nozzle 22 to determine an area of spray pattern 30 may be used to determine the area of spray patterns 30 for all of nozzles 22 and to calibrate the delivery of emulsion fluid for machine 10. Alternatively, machine 10 may include two or more types of nozzles 22, and each type of nozzle 22 may be measured and calibrated.

Figure 3:
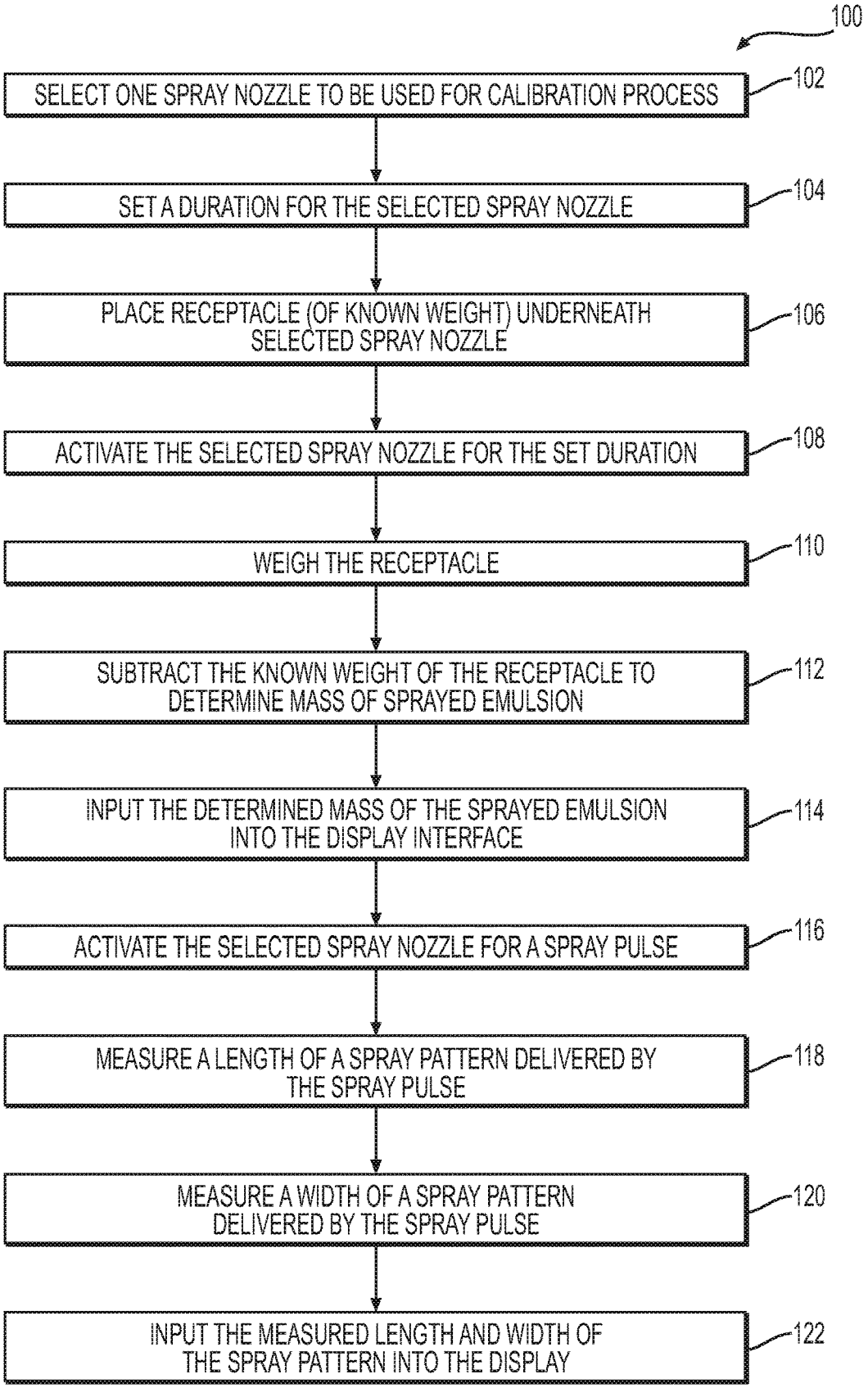
FIG. 3 provides a flowchart depicting an exemplary method for calibrating the delivery of emulsion fluid, according to aspects of this disclosure.

FIG. 3 provides a flowchart depicting an exemplary method 100 for calibrating the delivery of emulsion fluid. Method 100 includes determining a mass of delivered emulsion fluid per an area of ground surface (i.e., $kg/m^2$), which may then be used to calibrate the delivery of a particular emulsion fluid during a paving operation. As mentioned, different emulsion fluids, or the same fluid under different conditions (e.g., temperature, humidity, or altitude variations), may exhibit different densities, viscosities, or other properties that may affect the delivery rate and/or the spray area of the particular emulsion fluid. Accordingly, method 100 may be performed before initiating a particular paving operation, and the performance of method 100 may be prompted and/or assisted by ECM 24 and display interface 26.

Method 100 includes an initial step 102 of selecting one spray nozzle 22 to be used for the calibration process. Display interface 26 may be used to select the particular nozzle 22, for example, by placing the particular nozzle 22 in an active configuration with the remaining nozzles 22 in an inactive configuration. In one aspect, an outer-most nozzle 22 on one of side spray bars 20A may be used as the active nozzle 22 to allow for easier access for a user to position a receptacle under the active nozzle 22. Step 104 includes setting a duration for the selected spray nozzle 22. For example, a user may input a duration of, for example, five seconds for the active nozzle 22 to deliver emulsion fluid. Step 106 includes placing a receptacle of known weight underneath the selected spray nozzle 22. In one aspect, a cup, a bucket, or other receptacle may be weighed when empty in order to measure the weight of the receptacle, and then the receptacle may be positioned underneath the selected nozzle 22. Step 108 of method 100 includes activating the selected spray nozzle 22 for the selected duration. Depending on machine 10, the delivery of the emulsion fluid during the duration may be continuous, or may be delivered in intervals. In this step, the delivered emulsion fluid is collected in the receptacle. Next, step 110 includes weighing the receptacle, and step 112 includes subtracting the known weight of the receptacle to determine a mass of the sprayed emulsion fluid delivered in the set duration. In step 114, the mass of the sprayed emulsion fluid may be input into the display interface 26. As such, ECM 24 may determine a mass of emulsion fluid delivered as function of time. Additionally, because the duration of each spray pulse is known, ECM 24 may determine a mass of emulsion fluid delivered for each spray pulse.

Method 100 further includes step 116 that includes activating the selected spray nozzle 22 for one or more spray pulses. The one or more spray pulses may be one spray pulse, two spray pulses, etc., and the number of spray pulses delivered in step 116 may be set or adjusted on display interface 26 (FIG. 4). For example, spray pattern 30 may be clearer or more easily measured if two or more spray pulses are delivered to the ground surface compared to a single spray pulse. Step 116 may include an initial step of placing a large piece of paper, plywood, or other material on the ground surface below the selected spray nozzle 22 such that the material receives the delivered emulsion fluid. Alternatively, spray pattern 30 may measured directly on the ground surface. Next, step 118 of method 100 includes measuring a length of spray pattern 30 delivered by the one or more spray pulses (FIG. 2). Step 120 includes measuring a width of spray pattern 30 delivered by the one or more spray pulses. Then, step 122 includes inputting the measured length and width of spray pattern 30 into display interface 26. The length and width of spray pattern 30 may be entered individually such that ECM 24 may determine an area of spray pattern 30 formed by the one or more spray pulses, or the user may use the measured length and width to determine an area of spray pattern 30, which may then be entered into display interface 26.

It is noted that different measurements may be taken and input into display interface 26 if spray pattern 30 is a non-rectangular shape. Although not shown in the figures, display interface 26 may include a shape input, in which a user may input or select the shape of spray pattern 30. Similarly, display interface 26 may include one or more inputs for the user to input various measurements of spray pattern 30 for ECM 24 to determine an area of spray pattern 30.

Using method 100, ECM 24 may use the inputted measured mass of the sprayed emulsion and area of the spray pattern to determine a delivery rate (e.g., mass per area in $kg/m^2$) of emulsion fluid sprayed by nozzle 22. ECM 24 may apply the determined delivery rate to each nozzle 22 on spray bars 20, and ECM 24 may modify active nozzles 22 and/or the frequency of spray pulses as necessary during a paving operation in order to deliver the appropriate (desired or stored) amount of emulsion fluid to the appropriate portions of the ground surface. For example, ECM 24 may be coupled to one or more speed or direction sensors of machine 10 (i.e., sensors 29) that detect a speed or direction of machine 10, and ECM 24 may modify which of nozzles 22 are active and/or the frequency of spray pulses based on the detected speed or direction of machine 10 in order to maintain a consistent delivery of emulsion fluid to the ground surface. Moreover, ECM 24 may be coupled to one or more sensors that determine a width of screed 18, and ECM 24 may modify which of nozzles 22 are active and/or the frequency of spray pulses based on the detected width of screed 18.

FIG. 4 illustrates an exemplary control panel display 32 that may be displayed on display interface 26. Control panel display 32 may be a touch screen (e.g., an iPad®, tablet, etc.), or may instead include a display or a plurality of displays and one or more pushbuttons, switches, a keyboard, etc. Control panel display 32 displays a plurality of measured values, user input options, and other information to an operator of machine 10.

Control panel display 32 may include a plurality of display screens, which may be selectable via a plurality of tabs 34A-34L on a tool bar 36. For example, tool bar 36 may include a home tab 34A and a variety of other tabs 34B-34L to allow a user to toggle between a variety of other input and/or monitoring screens, which may include accessing corresponding settings or actuation control screens. FIG. 4 illustrates control panel display 32 being in a nozzle calibration mode or screen, for example, with tab 34F being active and the corresponding icon 38 being displayed on control panel display 32.

Nozzle calibration mode may include displaying a plurality of sensor values on control panel display 32. For example, control panel display 32 may display one or more of a compressor pressure 40, an emulsion fluid volume 42 in a supply, an emulsion fluid level 44 in the supply, and an emulsion fluid temperature 46 in the supply. Control panel display 32 may also display an emulsion fluid pump rate 48 and/or an emulsion fluid pressure 50. The aforementioned values and indications may be based on a plurality of sensors positioned on or within portions of machine 10 and wired or wirelessly coupled to ECM 24.

Nozzle calibration mode includes displaying a plurality of nozzle controls 52 and nozzle indicators 54. Nozzle controls 52 may allow a user to control (i.e., activate or deactivate) individual nozzles 22. Nozzle indicators 54 may illuminate or change color to indicate the operational status of individual nozzles 22 or sets of nozzles 22. The configuration of nozzle controls 52 and nozzle indicators 54 on control panel display 32 may correspond to, or be indicative of, the relative positioning of nozzles 22 along spray bars 20 on machine 10. In one aspect, nozzle controls 52 and nozzle indicators 54 may be combined into pushbuttons, switches, or touch screen icons to control nozzles 22.

Nozzle calibration mode also includes a plurality of displays and inputs that may be used in method 100. In one aspect, control panel display 32 may include a nozzle selection input 56 that includes a numerical indication of an active nozzle for the calibration method. The active nozzle may be adjusted via a down button 58 and an up button 60. For example, machine 10 may include sixteen nozzles 22 on spray bars 20 (as in FIG. 1), with each nozzle 22 being designated by a number between one and sixteen. The left most nozzle 22 on left side spray bar 20A may be nozzle number "1," and the right most nozzle 22 on right side spray bar 20A may be nozzle number "16." Although not shown, the active nozzle 22 may also be indicated with nozzle indicator 54 being illuminated, circled, or otherwise identified. Additionally, in the nozzle calibration mode, nozzle controls 52 may be inactive such only that nozzle selection input 56 controls which individual nozzle 22 is active for the calibration.

Nozzle calibration mode further includes a spray duration input 62 through which a user may set a duration for the selected spray nozzle 22, for example, in step 104. Spray duration input 62 may include a time display 64, a down button 66, an up button 68, and an activate button 70. A user may set the duration using down button 66 and up button 68, and may press activate button 70 once the receptacle has been positioned below the selected nozzle 22 in order to activate the selected nozzle 22 for the set duration in step 108. The user may then input the measured mass of the sprayed emulsion fluid, as in step 114. For example, control panel display 32 may include a mass input 72, which may include a down button 74 and an up button 76 to allow the user to input the measured mass of the sprayed emulsion fluid.

Nozzle calibration mode also includes a spray pulse input 78 through which a user may set a number of spray pulses, for example, before step 116. Spray pulse input 78 may include a pulse display 80, a down button 82, an up button 84, and an activate button 86. A user may set the number of spray pulses using down button 82 and up button 84, and may press activate button 86 to activate the selected spray nozzle for the set number of spray pulses in step 116. The user may then input the measured spray pattern 30. For example, control panel display 32 may include a length input 88 and a width input 90, each of which may include respective up and down buttons.

It is noted that the inputs shown in FIG. 4 are merely exemplary, and display interface 26 and control panel display 32 may include any number of displays and inputs. For example, nozzle calibration mode may include a numerical keypad. In one aspect, selecting nozzle selection input 56, spray duration input 62, mass input 72, spray pulse input 78, length input 88, or width input 90 may activate the keypad such that the user may input the appropriate numerical value. Moreover, rather than measuring a mass of emulsion fluid delivered in steps 110 and 112, method 100 may include measuring a volume of emulsion fluid delivered, for example, in a measuring cup. Display interface 26 may then include the appropriate inputs for a user to input the measured volume, and ECM 24 may determine a volume of emulsion fluid delivered over the area of spray pattern 30. Display interface 26 and control panel display 32 may also include a plurality of alarms and notifications based on the plurality of sensors associated with machine 10, and the alarms or notifications may be displayed on display interface and control panel display 32 regardless of the selected mode or current operation in order to advise the user. Furthermore, control panel display 32 may include additional inputs to allow a user to input information for a non-rectangular spray pattern and/or for multiple types of nozzles 22 coupled to machine 10.

INDUSTRIAL APPLICABILITY

The disclosed aspects of machine 10 may be used in any machine to assist in delivery of sprayed fluid, and in particular, to assist in the spraying of emulsion in a paving machine. During operation, spray bars 20 may deliver emulsion fluid to the ground surface traversed by machine 10 ahead of the delivered paving material to aid in the binding of the paving material to the ground surface. However, different paving materials may necessitate different emulsion fluids, and different emulsion fluids may include different properties, such as, for example, density, viscosity, etc. that may affect the delivery rate of the emulsion fluid. Furthermore, different paving conditions (e.g., temperature, humidity, altitude, etc.) may affect the flow and delivery rate of an emulsion fluid. The disclosed aspects of machine 10 may be used to allow a user to calibrate the delivery rate of a particular emulsion fluid to be delivered under the particular conditions of a specific paving operation.

For example, before beginning a paving operation, the user may select the nozzle calibration mode on display interface 26, which may prompt the user to perform method 100. For example, display interface 26 may prompt the user to select one nozzle 22, and to set a duration for the selected nozzle 22 using nozzle selection input 56 and spray duration input 62. The user may collect a mass of the emulsion fluid delivered through the selected nozzle 22, and input the mass of emulsion fluid into display interface 26. The user may also deliver a number of spray pulses to a ground surface or material on the ground surface to determined the area of spray pattern 30. The user may measure the spray length L and spray width W of spray pattern 30, and input length L and width W into display interface 26. ECM 24 may then determine a emulsion fluid delivery rate via nozzle 22 as a ratio of mass (kg) of emulsion fluid to the area of spray pattern 30 ($m^2$). Additionally, because the duration of each spray pulse is known, ECM 24 may determine a mass (kg) of emulsion fluid delivered for each spray pulse. ECM 24 may then use the measured delivery rate to calibrate each of nozzles 22 during the paving operation. For example, ECM 24 may compare the measured delivery rate to a target delivery rate and adjust one or more parameters of the emulsion fluid delivery. Additionally, based on changes in the speed and/or direction of machine 10, or in the width of screed 18, ECM 24 may adjust the active nozzles 22, the frequency of spray pulses (i.e., increase or decrease the frequency of spray pulses), and other parameters of the emulsion fluid delivery in order to maintain a consistent delivery rate of emulsion fluid to the ground surface. As such, ECM 24 may more accurately or efficiently deliver emulsion fluid to the ground surface, which may increase the binding of the paving material to the ground surface.

If the conditions or the type of emulsion fluid change during a paving operation, the user may repeat method 100 to recalibrate the emulsion fluid delivery rate. Similarly, if the target emulsion fluid delivery rate changes during the paving operation, the steps of method 100 may be repeated to help ensure the emulsion fluid delivery rate is in line with the target delivery rate. Method 100 may be performed as many times as necessary during the paving operation, and selecting the nozzle calibration tab 34F on display interface 26 and control panel display 32 may prompt the user to perform the calibration steps.

It will be apparent to those skilled in the art that various modifications and variations can be made to the disclosed machine without departing from the scope of the disclosure. Other embodiments of the machine will be apparent to those skilled in the art from consideration of the specification and practice of the control system for a paving machine disclosed herein. It is intended that the specification and examples be considered as exemplary only, with a true scope of the disclosure being indicated by the following claims and their equivalents.

What is claimed is:

1. A paving system, comprising:

a paving machine, including:

a paving material delivery assembly, including a hopper, a conveyor assembly, an auger, and a screed;

an emulsion fluid delivery assembly including a plurality of spray bars, wherein each spray bar includes one or more nozzles; and a controller and a display interface, wherein the controller is configured to receive inputs from the display interface indicative of a mass and an area of emulsion fluid delivered from one active nozzle in order to calibrate the emulsion fluid delivery assembly.

2. The paving system of claim 1, wherein the nozzles are opened or closed by one or more pneumatic valves, and wherein the controller is configured to control the opening and closing of the nozzles by controlling the pneumatic valves.

3. The paving system of claim 1, wherein the controller is in communication with one or more machine speed or machine direction sensors, and wherein the controller is configured to adjust an emulsion fluid delivery based on the sensed speed or direction of the machine.

4. The paving system of claim 1, wherein the display interface includes a plurality of selectable functions, and wherein one of the selectable functions is a nozzle calibration mode.

5. The paving system of claim 4, wherein the display interface is configured to receive one or more inputs to select the active spray nozzle.

6. The paving system of claim 5, wherein the display interface is configured to receive one or more inputs regarding an emulsion fluid delivery duration, and wherein the controller is configured to activate an active spray nozzle for the emulsion fluid delivery duration.

7. The paving system of claim 6, wherein the display interface is configured to receive one or more inputs regarding a mass of emulsion fluid delivered during the emulsion fluid delivery duration.

8. The paving system of claim 7, wherein the controller is configured to activate an active spray nozzle for one or two spray pulses, wherein the display interface is configured to receive one or more inputs regarding an area of a spray pattern of emulsion fluid delivered during the spray pulses, and wherein the controller is configured to determine an emulsion fluid delivery rate with respect to a mass per area.

9. The paving system of claim 1, wherein the plurality of spray bars includes two pivotable side spray bars, two rear spray bars positioned to the rear of tracks or wheels, and a central spray bar positioned between the tracks or wheels.

10. The paving system of claim 9, wherein the display interface displays each of the nozzles of the two pivotable side spray bars, two rear spray bars, and the central spray bar, and wherein the display interface displays which one nozzle is the active nozzle for calibration.

11. A control system for a paving machine, comprising:

a plurality of spray bars coupled to the paving machine to deliver an emulsion fluid to a ground surface, wherein each of the spray bars includes one or more nozzles;

a controller; and a display interface, wherein the controller is operatively coupled to the display interface and to each spray nozzle on the plurality of spray bars to calibrate a delivery of emulsion fluid through the nozzles based on an inputted mass of the emulsion fluid and an inputted area of a spray pattern through one active nozzle.

12. The control system of claim 11, wherein, in a nozzle calibration mode, the display interface is configured to receive inputs for at least one of the following:

select the active spray nozzle, select a spray duration, or select a number of spray pulses.

13. The control system of claim 11, wherein the controller is configured to activate the active spray nozzle for approximately 1 to 5 seconds for a spray duration for an emulsion fluid mass measurement.

14. The control system of claim 11, wherein the controller is configured to activate the active spray nozzle for one or more spray pulses for an emulsion fluid spray pattern area measurement.

15. The control system of claim 11, wherein during a paving operation, the controller is configured to receive information regarding a speed or direction of the paving machine, and wherein the controller is configured to adjust one or more parameters of the emulsion fluid delivery during the paving operation based on the calibrated delivery of the emulsion fluid and the information regarding the speed or direction of the paving machine.

16. A method of calibrating an emulsion fluid delivery system for a paving machine, comprising:

selecting an active nozzle, wherein the active nozzle is one of a plurality of nozzles on one or more spray bars mounted on the paving machine;

delivering an emulsion fluid through the active nozzle for a spray duration;

measuring a mass of the emulsion fluid delivered through the active nozzle over the spray duration;

inputting the measured mass of the emulsion fluid delivered through the active nozzle over the spray duration into a user interface;

delivering a spray pulse of the emulsion fluid through the active nozzle;

measuring a length and a width of a spray pattern of the emulsion fluid delivered during the spray pulse; and inputting the measured length and width of the spray pattern of the emulsion fluid delivered during the spray pulse into the user interface.

17. The method of claim 16, further including, before measuring the length and width of the spray pattern of emulsion fluid, activating the active nozzle for a second spray pulse.

18. The method of claim 16, wherein measuring the mass of the emulsion fluid includes measuring a mass of a receptacle, placing the receptacle beneath the active nozzle, and measuring the mass of the receptacle with the delivered emulsion fluid.

19. The method of claim 16, wherein the selecting of the active nozzle includes receiving one or more user inputs on the user interface.

20. The method of claim 19, wherein the spray duration for the delivery of the emulsion fluid through the active nozzle is based on one or more user inputs on the user interface to set or adjust the spray duration.

* * * * *